United States Patent [19]

Ogawa

[11] 3,958,547

[45] May 25, 1976

[54] SPRING-LOADED FUEL STORING DEVICE

[75] Inventor: Oyuki Ogawa, Kariya, Japan

[73] Assignee: Nippondenso Co., Ltd., Kariya, Japan

[22] Filed: Nov. 20, 1973

[21] Appl. No.: 417,486

[30] Foreign Application Priority Data

Nov. 27, 1972 Japan ..... 47-137001[U]

[52] U.S. Cl. ..... 123/198 D; 123/142

[51] Int. Cl.[2] ..... F02B 77/00

[58] Field of Search ..... 123/198 D, 198 DB, 198 R, 123/142; 251/61, 61.4; 138/28, 30, 31

[56] References Cited

UNITED STATES PATENTS 3,048,274 8/1962 Lundeen ..... 251/61.4 X 3,134,395 5/1964 Glasgow ..... 251/61

*Primary Examiner*—Charles J. Myhre
*Assistant Examiner*—Ira S. Lazarus
*Attorney, Agent, or Firm*—Edwin E. Greigg

[57] ABSTRACT

What follows is the description of a spring-loaded device for use in the fuel system of an internal combustion engine. The device includes a spring-loaded membrane connected to a valve which in turn provides access to atmospheric air. The arrangement is such that the danger of fuel escaping into the atmosphere or into the engine compartment is prevented.

3 Claims, 1 Drawing Figure

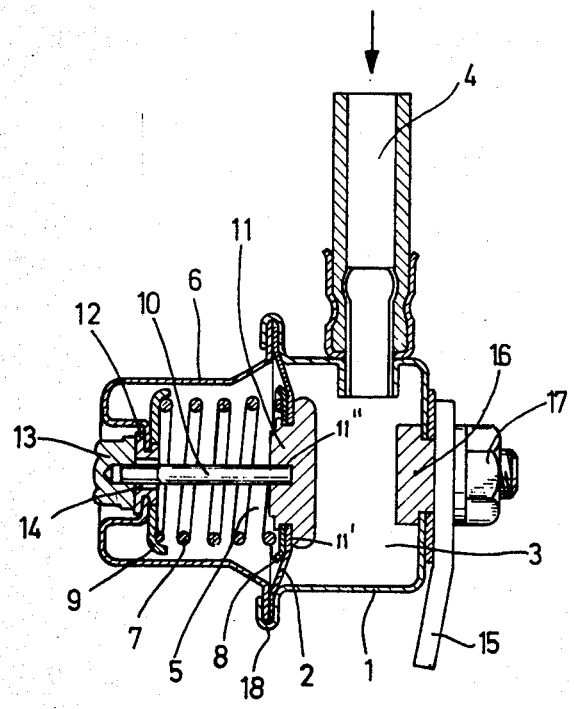
4
11
6
10
12
16
17
13
11''
14
11'
3
9
7
5
8
18
2
1
15

SPRING-LOADED FUEL STORING DEVICE

BACKGROUND OF THE INVENTION

The present invention relates to a spring-loaded storage device for a fuel system of an internal combustion engine having a membrane which serves as a flexible member.

The spring-loaded storage device is arranged in a fuel system for internal combustion engines and serves to reduce the pressure fluctuations in the fuel system and to dampen fuel pulsations deriving from the fuel pump.

In addition, the spring-loaded storage device serves to maintain the pressure in the fuel system over a longer period of time after the engine has been turned off, thereby ensuring that the engine has a warm start.

It is already known to provide spring-loaded storage devices with a membrane operating against the force of a spring; the membrane consisting of an elastic material which is acted on by fuel on one side and by atmospheric air on the other. With these devices, however, there exists the risk that when the membrane is broken, fuel can escape into the atmosphere or into the engine compartment resulting in the engine being rendered inoperative or even causing fires.

OBJECTS AND SUMMARY OF THE INVENTION

It is, therefore, an object of the present invention to provide a spring-loaded device for a fuel system of an internal combustion engine wherein the fuel is prevented from escaping from the spring-loaded device into the atmosphere or engine compartment in spite of the occurrence of a damaged membrane.

This and other objects are achieved according to the present invention in that a chamber in the spring-loaded device is adapted to be brought into communication with the atmosphere by way of a valve activated by the membrane.

An advantageous feature of the present invention consists in that with minimal pressure differences on both sides of the membrane, the valve is adapted to be closed by the force of a spring and that the membrane has at its center a holder for a connecting rod; a closing member of the valve being secured to the end of the connecting rod facing away from the membrane.

Another advantageous feature of the present invention consists in that the valve is in the form of a flat seat valve with a closing member and a sealing disc serving as the fixed valve seat; the sealing disc being provided with an opening in its center through which the end of the connecting rod facing away from the membrane projects.

BRIEF DESCRIPTION OF THE DRAWING

The sole FIGURE of the drawing illustrates in cross section a spring-loaded device for use in the fuel system of an internal combustion engine including a membrane and valve arrangement for atmospheric communication.

DESCRIPTION OF THE PREFERRED EMBODIMENT

The embodiment of the invention which is shown in the drawing will now be described in more detail.

The spring-loaded device consists of a housing member 1 which, together with a membrane 2, forms a storage chamber 3. Fuel can flow through an inlet connection 4. The membrane 2 separates the chamber 3 from a chamber 5, which in turn is formed by the membrane 2 and a housing member 6. A spring 7 is arranged in the chamber 5. This spring 7 is supported between a spring abutment ring 8 mounted in conjunction with the membrane 2 and a spring abutment ring 9 mounted to one end of the housing member 6. A retaining member 11 is supported by the membrane 2 at its center. The retaining ring 11 includes a recess 11', within which both a center portion of the membrane 2 and of the abutment ring 8 are secured. The outer portion of the membrane 2 is secured by a double-flanged joint 18 formed by the housing members 1 and 6, thereby fixing the membrane 2 in the plane of contiguity of both housing members and such that the membrane 2 assumes a position transverse to the longitudinal axis of the spring-loaded device. The retaining ring 11 also includes a recess 11'' which receives one end of a connecting rod 10. The connecting rod 10 is fixedly secured within the recess 11''. To the opposite end of the connecting rod 10 facing away from the membrane 2 there is connected a closing member 13 of a valve. The closing member 13 cooperates with a disc 12 which is rigidly connected to the housing member 6.

The sealing disc 12 has a centrally located aperture 14, through which the connecting rod 10 extends so that when the valve 12, 13 is open, chamber 5 communicates with the atmospheric air.

The spring-loaded device is fastened to a mounting plate 15 by means of a screw 16 connected to the housing member 1 and a nut 17.

The above-described spring-loaded device operates as follows:

Fuel is supplied to the chamber 3 in the direction of the arrow through the inlet connection 4. As soon as fuel is delivered under pressure to the chamber 3, the membrane 2 can yield into the chamber 5 against the force of the spring 7. During this process, the valve 12, 13, coupled with the membrane 2 via the connecting rod 10, is opened and the closing member 13 moves away from the sealing disc 12; thus, the chamber 5 communicates with the atmosphere via the opening 14.

In case the membrane 2 is damaged, fuel could flow from the chamber 3 into the chamber 5; since the pressures on both sides of the membrane 2 are now approximately equal, the force of the spring 7 would close the valve 12, 13. From this point on, the spring 7 holds the valve 12, 13 continuously in its closed position, thereby precluding outflow of fuel from the spring-loaded device to the surroundings.

The spring-loaded device according to the present invention could be utilized in a fuel system such as that shown and described in U.S. Pat. No. 3,500,803, issued to E. D. Long on Mar. 17, 1970.

What is claimed is:

1. In combination with a fuel system of an internal combustion engine, a spring-loaded device for use in the fuel system to maintain pressure therein and ensure warm starting of the engine, comprising, a. a housing, b. a flexible membrane mounted within said housing and defining two chambers with said housing, c. fuel supply means extending to one of said chambers, said fuel supply means and said one chamber defining a portion of a fuel flow path d. means defining a perforation in a wall of the housing communicating the other of said chambers with the atmosphere, e. rod means extending through said means defining the perforation and into said other chamber and having a terminus connected to said flexible membrane, f. spring means, g. means mounting said spring means in said other chamber between the perforation and the diaphragm, and h. said rod means further including means at a distal end portion thereof operative with said spring means to close the perforation and thereby prevent the fuel from diverting from its defined fuel flow path and flowing to the atmosphere from said other chamber upon inadvertent fracture of said flexible membrane.

2. In a spring-loaded device as claimed in claim 1, in which the said spring is coaxial with said means extending through said means defining the perforation and is interposed between the flexible member and the said wall of the housing forming the other of said chambers.

3. In a spring-loaded device as claimed in claim 1, in which the means defining the perforation includes means defining a sealing disc.

* * * * *